US007913676B2

(12) United States Patent
Breuninger et al.

(10) Patent No.: US 7,913,676 B2
(45) Date of Patent: Mar. 29, 2011

(54) INTERNAL COMBUSTION ENGINE

(75) Inventors: Tobias Breuninger, Halle a.d. Saale (DE); Hartmut Sauter, Renningen (DE); Yakup Ozkaya, Kornwestheim (DE)

(73) Assignee: Mahle International GmbH (DE)

( * ) Notice: Subject to any disclaimer, the term of this patent is extended or adjusted under 35 U.S.C. 154(b) by 426 days.

(21) Appl. No.: 12/096,993

(22) PCT Filed: Dec. 6, 2006

(86) PCT No.: PCT/DE2006/002166
§ 371 (c)(1),
(2), (4) Date: Jul. 17, 2008

(87) PCT Pub. No.: WO2007/076758
PCT Pub. Date: Jul. 12, 2007

(65) Prior Publication Data

US 2008/0295814 A1 Dec. 4, 2008

(30) Foreign Application Priority Data

Dec. 12, 2005 (DE) ..... 10 2005 059 668

(51) Int. Cl.
*F02B 25/00* (2006.01)

(52) U.S. Cl. ..... 123/572; 123/73 V; 123/65 V; 123/65 WV

(58) Field of Classification Search ..... 123/73 CC, 123/73 V, 65 V, 65 WV, 572–574
See application file for complete search history.

(56) References Cited

U.S. PATENT DOCUMENTS

| | | | | |
|---|---|---|---|---|
| 4,368,698 | A * | 1/1983 | Matsuo et al. | 123/184.49 |
| 4,579,092 | A | 4/1986 | Kandler | |
| 5,069,192 | A | 12/1991 | Matsumoto et al. | |
| 6,167,874 | B1 * | 1/2001 | Becker et al. | 123/572 |
| 6,401,701 | B1 * | 6/2002 | Liu | 123/572 |
| 6,418,918 | B2 * | 7/2002 | Mammarella | 123/572 |
| 6,425,451 | B2 * | 7/2002 | Yoshida et al. | 180/219 |

(Continued)

FOREIGN PATENT DOCUMENTS

DE 1 771 321 7/1958

(Continued)

OTHER PUBLICATIONS

English Abstract for DE 100 42 462.

(Continued)

*Primary Examiner* — Hai H Huynh
(74) *Attorney, Agent, or Firm* — Rader, Fishman & Grauer PLLC

(57) ABSTRACT

The invention relates to an internal combustion engine (1), in particular in a motor vehicle, having a fresh air system (3) for supplying fresh air, which is extracted from the environment (20) of the internal combustion engine (1), to combustion chambers (13) of the internal combustion engine (1), and having a degassing system (5) for discharging blowby gas from a crankcase (6) of the internal combustion engine (1) and for supplying the blowby gas to the fresh air of the fresh air system (3). Furthermore, the degassing system (5) has an oil separator (35) for removing oil from the blowby gas. In order to improve the performance of the oil separator (35), a vacuum opening valve (37) is connected to the crankcase (6). Said vacuum opening valve (37) opens as a function of a vacuum prevailing in the crankcase (6), and then permits an inflow of fresh air into the crankcase (6).

20 Claims, 2 Drawing Sheets

U.S. PATENT DOCUMENTS

Figure 1:
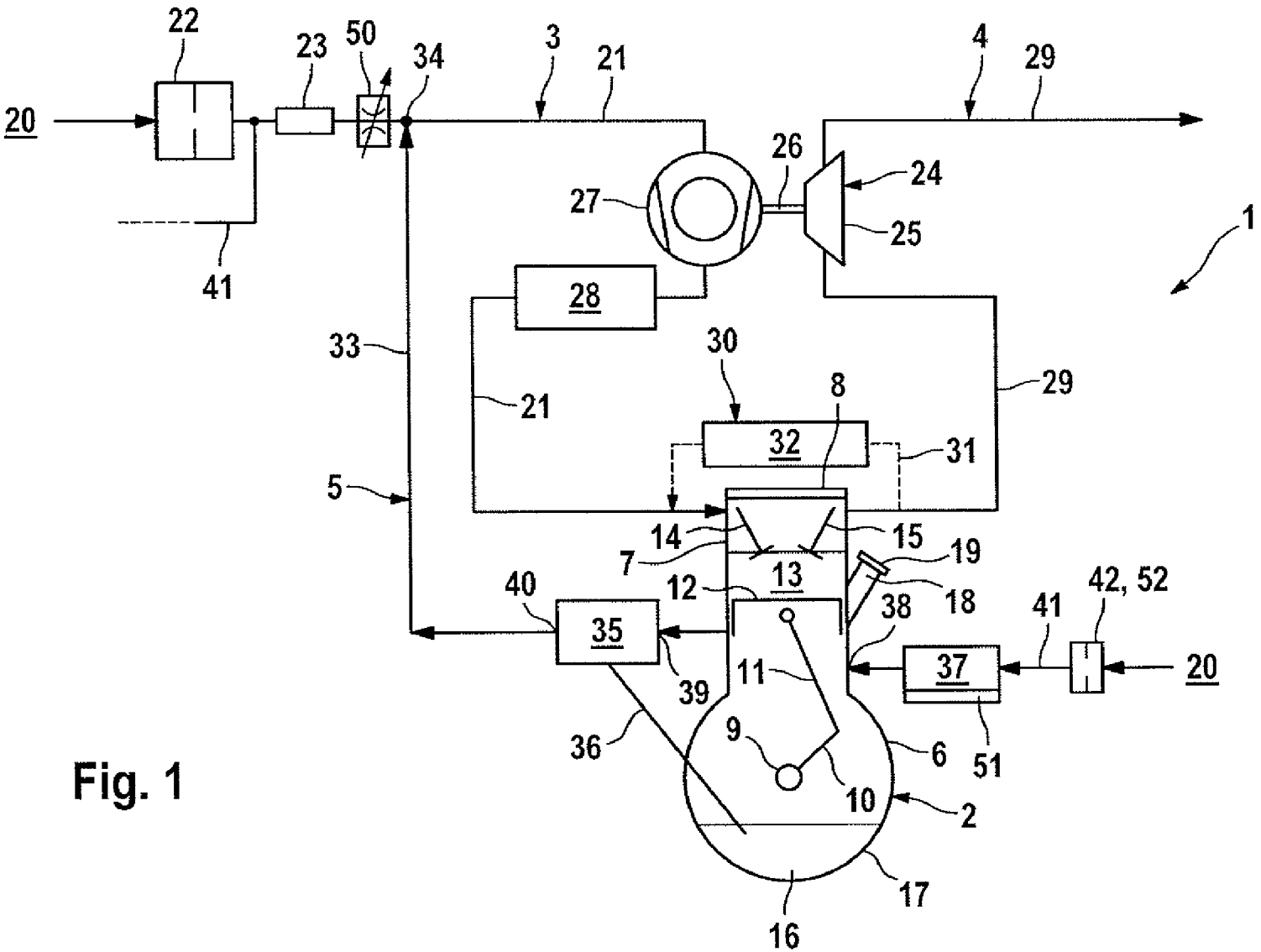

| | | | | |
|---|---|---|---|---|
| 6,659,093 | B2 * | 12/2003 | Kim | 123/572 |
| 7,007,682 | B2 * | 3/2006 | Takahashi et al. | 123/572 |
| 7,040,306 | B2 * | 5/2006 | Moriyama et al. | 123/572 |
| 7,100,587 | B2 * | 9/2006 | Ahlborn et al. | 123/572 |
| 7,281,532 | B2 * | 10/2007 | Kakimoto et al. | 123/572 |
| 7,426,924 | B2 * | 9/2008 | Withrow et al. | 123/572 |
| 7,789,076 | B2 * | 9/2010 | Borgstrom et al. | 123/572 |

FOREIGN PATENT DOCUMENTS

| | | |
|---|---|---|
| DE | 27 02 621 | 8/1977 |
| DE | 195 04 675 | 8/1995 |
| DE | 197 47 740 | 6/1998 |
| DE | 100 42 462 | 3/2002 |
| DE | 100 49 429 | 4/2002 |
| DE | 101 36 463 | 2/2003 |
| DE | 103 35 909 | 3/2005 |
| GB | 2 262 134 | 6/1993 |
| WO | WO-02/070871 | 9/2002 |
| WO | WO-2004/067925 | 8/2004 |

OTHER PUBLICATIONS

English Abstract for DE 100 49 429.
English Abstract for DE 101 36 463.
English Abstract for DE 103 35 909.
English Abstract for DE 195 04 675.
English Abstract for DE 197 47 740.
Meinig, U., u.a.: Kurbelgehause-Entluftung . . . , Aktuelle Entluftungssysteme In: MTZ-Motortechnische Zeitschrift, ISSN 0024-8525, 2004, Jg. 65.
Meinig, U., u.a.: Kurbelgehause-Entluftung . . . , Neue Konzepte, In: MTZ-Motortechnische Zeitschrift, ISN 0024-8525, 2004, Jg. 6t5.

* cited by examiner

INTERNAL COMBUSTION ENGINE

CROSS-REFERENCE TO RELATED APPLICATION

This application is a National Stage application which claims the benefit of International Application No. PCT/DE2006/002166 filed Dec. 6, 2006, which claims priority based on German Patent Application No. DE 10 2005 059 668.1, filed Dec. 12, 2005, both of which are hereby incorporated by reference in their entirety.

The present invention relates to an internal combustion engine, in particular in a motor vehicle.

An internal combustion engine usually comprises a fresh air system for supplying fresh air extracted from the environment of the internal combustion engine to combustion chambers of the internal combustion engine. During operation of the internal combustion engine, so-called blow-by gas can enter a crankcase of the internal combustion engine due to leakage of the pistons moving in the cylinders of the internal combustion engine.

Modern internal combustion engines are equipped with a degassing system, which serves to remove blow-by gas from the crankcase and to add the blow-by gas to the fresh air of the fresh air system. The blow-by gas removed from the crankcase may contain oil, for example, in the form of an oil mist, which is formed during operation in the crankcase. In order for this oil not to enter the fresh air and in order to reduce the oil consumption of the internal combustion engine, it is customary to provide an oil separator in the degassing system to remove oil from the blow-by gas. The separated oil is preferably recycled back to an oil sump of the crankcase. In the case of passive oil separators such as cyclones, the driving force for the separation of oil from the blow-by gas is the pressure difference made available between an inlet and an outlet of the oil separator; the greater this pressure difference, the better the oil separation functions.

In order for the vacuum prevailing in the fresh air system not to be able to spread into the crankcase, which would lead to damage to the internal combustion engine, it is fundamentally possible to equip the degassing system with a pressure-regulating valve which is arranged upstream or downstream from the oil separator in the blow-by gas path. Blow-by gas can then be removed from the crankcase only at a predetermined pressure. The disadvantage here is that such a pressure-regulating valve necessarily has a flow resistance which leads to a pressure drop in flow through the pressure-regulating valve. This pressure drop reduces the pressure difference that can be applied between the inlet and outlet of the oil separator and thereby reduces its cleaning effect.

This is where the present invention begins. The invention relates to the problem of providing an improved embodiment for an internal combustion engine of the type defined in the preamble, which is characterized in particular by an improved cleaning effect of the oil separator.

This problem is solved according to this invention by the subject matter of the independent claim. Advantageous embodiments are the subject matter of the dependent claims.

The present invention is based on the general idea of connecting a vacuum opening valve, which opens as a function of the vacuum prevailing in the crankcase, to the crankcase. The opened vacuum opening valve allows fresh air to flow in, e.g., from the environment into the crankcase and thereby prevents a further pressure drop in the crankcase. Accordingly, the vacuum opening valve prevents damage to the internal combustion engine due to an excessive vacuum in the crankcase. This advantageous effect of the vacuum opening valve results in the fact that a pressure-regulating valve in the blow-by gas path may be omitted. Subsequently, this also eliminates the pressure drop in flow through such a pressure-regulating valve, so that a greater pressure difference can be made available between the inlet and outlet of the oil separator, which improves the cleaning effect of the oil separator. In addition, during operation of the internal combustion engine a pressure difference may be continuously applied between the inlet and outlet of the oil separator, thereby permitting continuous operation of the oil separator and continuous removal of the blow-by gas.

In a preferred embodiment, an air filter may be provided in a flow path carrying fresh air through the vacuum opening valve into the crankcase. Due to this design, the fresh air intake from the environment into the crankcase is filtered, thereby preventing contamination of the oil lubricant in the crankcase.

Said air filter may expediently be integrated into the vacuum opening valve. With this design, the air filter and the vacuum-regulating valve are accommodated in a common housing, so that this is a compact module.

Essentially, the vacuum opening valve may be installed in any location. For example, a corresponding connecting line can connect the vacuum opening valve to an opening of the internal combustion engine which communicates with the crankcase. However, it is especially advantageous to insert the vacuum opening valve directly into said opening, so that this yields an extremely compact design.

In an especially advantageous embodiment, the vacuum opening valve may optionally be designed together with the air filter on an oil filling cover of the internal combustion engine or integrated into such an oil filling cover. The oil filling cover thereby has an additional functionality, whereby at the same time the require installation space for installing the vacuum opening valve is reduced. In addition, the invention can thereby be retrofitted especially easily.

Additional important features and advantages of the invention are derived from the subclaims, the drawings and the respective description of the figures on the basis of the drawings.

It is self-evident that the features described above and those yet to be explained below may be used not only in the particular combination given but also in other combinations or alone without going beyond the scope of the present invention.

Preferred exemplary embodiments of the invention are depicted in the drawings and are described in greater detail in the following description, where the same reference numerals are used to refer to the same or similar or functionally identical components.

They each show schematically

Figure 2A:
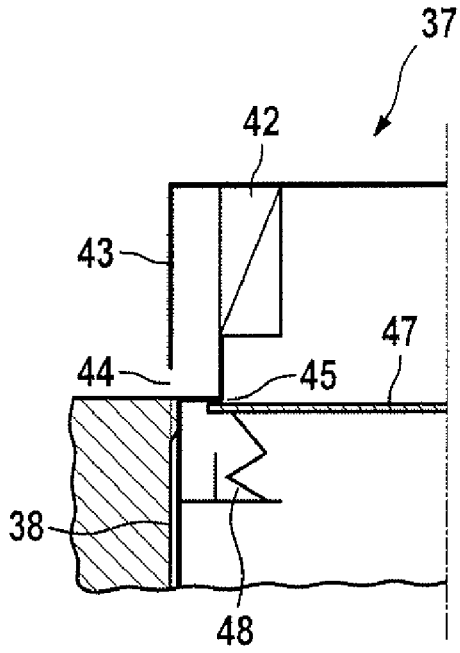
Figure 2B:
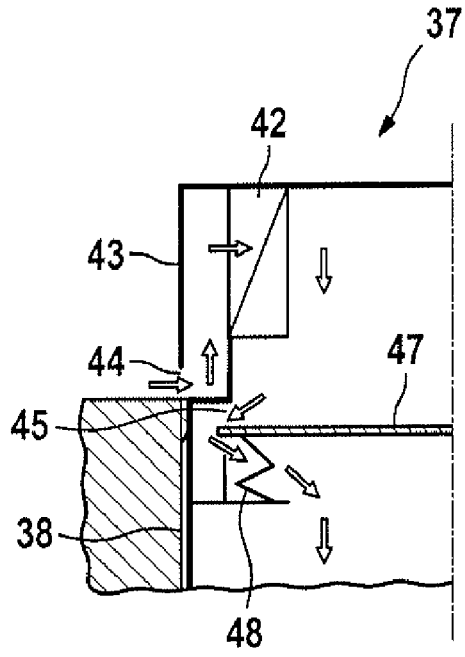
Figure 3:
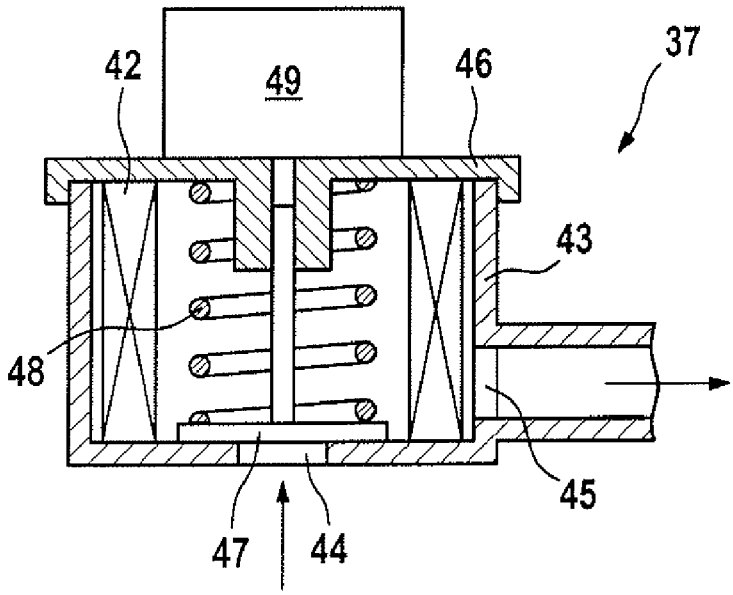

FIG. 1 a schematic diagram like a wiring diagram of an internal combustion engine, FIG. 2*a* a greatly simplified schematic longitudinal section through a vacuum opening valve in its closed position, FIG. 2*b* a view like that in FIG. 2*a* but with the vacuum opening valve in its open position, FIG. 3 a greatly simplified schematic longitudinal section through a vacuum opening valve in another embodiment.

According to FIG. 1, an internal combustion engine 1, preferably installed in a motor vehicle, comprises an engine block 2, a fresh air system 3, an exhaust system 4 and a degassing system 5. The engine block 2 is designed in the usual manner and comprises a crankcase 6, a cylinder head 7 and a rocker cover 8. A crankshaft 9 is arranged in the crankcase 6 and drives connecting rods 11 via connectors 10 and by means of them drives pistons 12 in a variable stroke process in the respective cylinders 13. In the simplified sectional view shown here, only one piston 12 can be seen in the respective cylinder 13. Intake valves 14 and exhaust valves 15 are indicated symbolically. Lubrication of the crankcase 9 and the other movable components 10 through 12 is accomplished in the crankcase 6. In doing so, an oil sump 16 develops in the crankcase 6. The lower area of the crankcase 6 where the oil sump 16 develops is also referred to as the oil pan 17. To be able to add fresh oil to the crankcase 6, the engine block 2 is also equipped with an oil filling connection 18, which is usually sealed with an oil filling cover 19.

The fresh air system 3 serves to take in fresh air from the environment 20 of the internal combustion engine 1 to supply this fresh air to combustion chambers of the internal combustion engine 1, i.e., to the cylinders 13. To do so, the fresh air system 3 comprises a fresh air line 21 in which an air filter 22 is usually arranged. A hot film meter 23, for example, may be arranged downstream from the air filter 22 to determine the amount of fresh air intake.

The preferred embodiment of the internal combustion engine 1 shown here, which is designed as a diesel engine or a gasoline engine or a natural gas engine, for example, is also equipped with a charger 24, which serves to charge the fresh air intake. In this example, it is a turbocharger 24, which comprises a turbine 25 and a compressor 27 connected thereto via a common drive shaft 26. Said compressor 27 is situated in the fresh air line 21 and leads to the desired compression of the fresh air intake. Downstream from the compressor 27, a charge air cooler 28 may be arranged in the fresh air line 21.

The exhaust system 4 serves to remove exhaust gases from the internal combustion engine 1 from their cylinders and/or combustion chambers 13. To do so, the exhaust system 4 comprises an exhaust line 29 in which the turbine 25 is arranged. Downstream from the turbine 25 the exhaust line 29 may contain the usual equipment for exhaust gas purification and noise abatement.

In the example shown here, the internal combustion engine 1 is also equipped with an exhaust gas recirculation system 30 which recycles exhaust gas from the exhaust gas line 29 through an exhaust gas cooler 32 into the fresh air line 21 with the help of an exhaust gas recirculation line 31.

The degassing system 5 serves to remove blow-by gas from the crankcase 6 and add it to the fresh air of the fresh air system 3. To do so, the degassing system 5 comprises a blow-by gas line 33 which is connected at one end to the crankcase 6 and at the other end to the fresh air line 21 at a connection point 34. An oil separator 35 which may be designed in the manner of a cyclone, for example, is arranged in the blow-by gas line 33. The oil separator 35 serves to remove oil entrained, e.g., in the form of droplets or mist, in the blow-by gas from the blow-by gas. The separated oil can be recycled back to the crankcase 6, preferably to the oil sump 16 with the help of a return line 36.

According to this invention, the internal combustion engine 1 is also equipped with a vacuum opening valve 37. The vacuum opening valve 37 is designed so that it opens depending on a vacuum prevailing in the crankcase 3, and in the open position it allows fresh air to flow into the crankcase 6 from the environment 20. To do so, the vacuum opening valve 37 is connected to the crankcase 6 via a connection site 38. Due to the inventive design, the entire vacuum prevailing in the fresh air line 21 can be used more or less to generate a pressure difference between an inlet 39 and an outlet 40 of the oil separator 35. Ultimately—apart from flow losses of the blow-by gas line 33—the entire pressure difference between the pressure prevailing in the crankcase 6 and the pressure prevailing in the fresh air line 21 is available between the inlet 39 and the outlet 40 of the oil separator 35. If the oil separator 35 operates passively and is driven by the pressure difference prevailing between the inlet 39 and outlet 40, this yields an especially high efficiency and cleaning effect for the oil separator 35. In addition, a pressure difference can be established continuously between the inlet 39 and outlet 40 during operation of the internal combustion engine 1, so that the oil separator 35 constantly draws blow-by gas out of the crankcase 6 and sends it to the fresh air line 21. An increase in pressure in the crankcase 6 and thus the risk of damage to the internal combustion engine 1 due to excess pressure can therefore be effectively prevented.

For the special case when the degassing system 5 is not functioning, e.g., when the blow-by gas line 33 is clogged, in particular due to ice in the area of the connection 34, an excess pressure may build up in the crankcase 6. In order for this excess pressure not to result in damage to the engine block 2, in addition to the vacuum opening valve 37, a pressurized opening valve 51 may also be provided. The pressurized opening valve 51 is connected directly or indirectly to the crankcase 6 and is designed so that it opens as a function of an excess pressure prevailing in the crankcase 6 and allows blow-by gas to flow out of the crankcase 6, e.g., into the environment 20. In the embodiment shown in FIG. 1, the pressurized opening valve 51 is integrated into the vacuum opening valve 37.

The increased efficiency of the oil separator 35 is made possible by the vacuum opening valve 37 situated outside of and/or independently of the blow-by gas line 33. Whereas the blow-by gas line 33 ensures that a critical excess pressure cannot build up in the crankcase 6, the vacuum opening valve 37 ensures that no critical vacuum can build up in the crankcase 6. Because the vacuum opening valve 37 allows the aeration of the crankcase 6 with fresh air from the environment 20 as a function of the vacuum prevailing in the crankcase 6. A drop in the pressure in the crankcase 6 into critical vacuum ranges may thus be effectively prevented.

An air filter 42 is preferably arranged in a flow path 41 leading from the environment 20 through the vacuum opening valve 37 to the crankcase 6. In comparison with the air filter 22 arranged in the fresh air line 21, the air filter 42 arranged in said flow path 41 is small. The small air filter 42 cleans the fresh air intake from the environment 20 and reduces the risk of contamination of the crankcase 6 and/or the oil lubricant. The small air filter 42 is preferably arranged upstream from the vacuum opening valve 37 in the flow path 41 so that the vacuum opening valve 37 is protected from contamination. It is likewise basically possible for the small air filter 42 to be arranged downstream from the vacuum opening valve 37. Furthermore, an integral design is possible in which the small air filter 42 is arranged in a housing of the vacuum opening valve 37.

With the pressurized opening valve 51, which is integrated into the vacuum opening valve 37, the flow path 41 is at the same time utilized to remove the blow-by gas from the crankcase 6 when there is an excess pressure in the crankcase 6. It may be expedient here to provide an activated carbon filter 52 in the flow path 41 to adsorb the contaminants entrained in the blow-by gas so that essentially only noncritical gas enters the environment 20. It is especially advantageous here to integrate said activated carbon filter 52 into the small air filter 42. In subsequent normal operation, i.e., when supplying fresh air from the environment 20 through the vacuum opening valve 37 into the crankcase 6, the activated carbon filter 52 is regenerated by the fact that the fresh air resorbs the contaminants deposited there again.

In an alternative embodiment, it is possible to connect the flow path 41 to the fresh air line 21 of the fresh air system 3, namely upstream from a throttle site and downstream from a filter site. The throttle site is usually formed by an intake throttle 50 situated in the fresh air line 21, a so-called throttle valve. The filter site is usually formed by the air filter 22 and/or by the air filter element arranged in the air filter 22.

The connection site 38 by which the vacuum opening valve 37 is connected to the crankcase 6 may be in general an opening formed on the engine block 2 which communicates with the crankcase 6 and is also labeled as 38 below. In the example shown here, said opening 38 is formed directly on the crankcase 6. It is likewise possible to form said opening 38 on the cylinder head 7 or on the rocker cover 8. In addition, it is conceivable for the vacuum opening valve 37 to be connected to said opening 38 via a connecting line (not shown). However, a design in which the vacuum opening valve 37 is mounted directly on the engine block 2 and is inserted directly into the respective opening 38 accordingly, in particular being screwed in place there, is preferred.

In an especially advantageous embodiment (not shown here), the vacuum opening valve 37 may be formed on the oil filling cover 19 and/or may be integrated into the oil filling cover 19. For example, said opening 38 may be situated in the oil filling cover 19. If a small air filter 42 is provided, this is then in or on the oil filling cover 19.

According to FIGS. 2 and 3, the vacuum opening valve 37 comprises a housing 43 with an inlet opening 44 and an outlet opening 45. In the example shown here, the small filter 42 is situated in the housing 43. The small filter 42 is in a flow path connecting the inlet opening 44 to the outlet opening 45. For example, the small air filter 42 is designed as a ring filter element. The housing 43 may be sealed with a cover 46 which makes it possible to replace the small air filter 42. As FIGS. 2*a* and 2*b* indicate, the vacuum opening valve 37 may be screwed into the opening 38.

The vacuum opening valve 37 contains a valve member 47 in the form of a plate, for example. In the embodiment according to FIGS. 2*a* and 2*b*, the valve member 47 controls the outlet opening 45. In contrast with that, the valve member 47 in the embodiment according to FIG. 3 controls the inlet opening 44. To prestress the valve member 47 into a closed position in which it seals off the respective opening 44 or 45, a closing pressure spring 48 may be provided. In the embodiment shown in FIG. 3, a final control element 49 is also shown, which may be present additionally or as an alternative to the closure pressure spring 48. The control element 49 may be designed as a snap switch, for example, may be operable electrically or pneumatically and may allow an electronic state query in particular. In this way, the vacuum opening valve 37 may be connected to a vehicle electric system, for example, which performs an on-board diagnosis of the degassing system 5. The prevailing switch setting and/or valve setting of the vacuum opening valve 37 can be determined via the state of the control element 49 and this setting in turn provides information about the fresh air stream currently being supplied to the crankcase 6.

According to FIG. 2*a* and FIG. 3, the valve member 47 and thus the vacuum opening valve 37 have a closed position in which no fresh air flows through the respective opening 44 or 45. If a predetermined vacuum develops in the crankcase 6, this leads to an opening movement of the valve member 47 against the closing force of the closing pressure spring 48. According to FIG. 2*b*, the valve member 47 and/or the vacuum opening valve 37 has an open position in which the respective opening 44 and/or 45 is opened and allows aeration of the crankcase 6 with fresh air.

In a simple embodiment, the vacuum opening valve 37 is designed so that it opens at a predetermined vacuum prevailing in the crankcase 6 and closes at any pressure higher than that. It is clear here that the vacuum opening valve 37 opens more strongly, the further the pressure in the crankcase 6 drops below the predetermined vacuum, depending on the design. By opening the vacuum opening valve 37, fresh air flows into the crankcase 6, which leads to an equalization of pressure, so that the pressure in the crankcase 6 again rises above the predetermined vacuum.

In another more complex embodiment (not shown here), the vacuum opening valve 37 may also be designed in such a way that it opens with a first opening cross section at a predetermined first vacuum in the crankcase 6 and opens with a second opening cross section, which is larger than the first opening cross section, at a predetermined second vacuum which is greater in amount than the first vacuum. The vacuum opening valve 37 closes only in the case of pressures which are above the first vacuum. In this design, only the first opening cross section is needed for aeration of the crankcase 6 for especially frequent operating states of the internal combustion engine 1 with a low or moderate load. In extraordinary operating states, preferably at full load, it may be necessary to increase the aeration of the crankcase 6, to which end the second larger opening cross section is released.

In an alternative embodiment, the vacuum opening valve 37 may also be designed so that it is open constantly with a first opening cross section at all pressures in the crankcase 6 which are above a predetermined vacuum, and at said predetermined vacuum in the crankcase it opens with a second opening cross section, which is greater than the first opening cross section. Thus in this embodiment the first opening cross section is permanently active, regardless of the pressure prevailing in the crankcase 6. Only when the pressure in the crankcase 6 drops below the predetermined vacuum is the required greater aeration, e.g., at full load of the internal combustion engine 1, ensured through activation of the larger second opening cross section.

The invention claimed is:

1. An internal combustion engine comprising:

a fresh air system for supplying fresh air taken from an environment of the internal combustion engine to combustion chambers of the internal combustion engine, a degassing system for removing blow-by gas from a crankcase of the internal combustion engine and for supplying the blow-by gas to the fresh air of the fresh air system, the degassing system including an oil separator for removing oil from the blow-by gas and a blow-by gas line that connects the crankcase directly to an inlet of the oil separator and connects an outlet of the oil separator directly to a fresh air line of the fresh air system and a vacuum opening valve connected to the crankcase, wherein the vacuum opening valve opens as a function of a vacuum prevailing in the crankcase and allows an influx of fresh air into the crankcase.

2. The internal combustion engine according to claim 1 further comprising an air filter arranged in a flow path carrying the fresh air through the vacuum opening valve into the crankcase.

3. The internal combustion engine according to claim 2, wherein the air filter is arranged at least one of upstream and downstream from the vacuum opening valve.

4. The internal combustion engine according to claim 2, wherein the air filter and the vacuum opening valve are arranged in a common housing.

5. The internal combustion engine according to claim 1 further comprising a flow path for carrying the fresh air through the vacuum opening valve into the crankcase, the flow path connected to the fresh air system at a location downstream from a filter site and upstream from a throttle site.

6. The internal combustion engine according to claim 1 further comprising an opening communicating with the crankcase, wherein the opening is at least one of connected via a connecting line to the vacuum opening valve and inserted directly into the vacuum opening valve.

7. The internal combustion engine according to claim 6, wherein the opening is at least one of formed on the crankcase, on a cylinder head, and on a rocker cover.

8. The internal combustion engine according to claim 1, wherein the vacuum opening valve includes a valve member that controls at least one of an inlet opening and an outlet opening of the vacuum opening valve.

9. The internal combustion engine according to claim 8, wherein the vacuum opening valve includes a closing pressure spring that prestresses the valve member into a closed position.

10. The internal combustion engine according to claim 8, wherein the vacuum opening valve includes a control element for adjusting the valve member.

11. The internal combustion engine according to claim 1, wherein the oil separator is driven by a pressure difference between a pressure prevailing at a connection site between the blow-by gas line and the fresh air line and a pressure prevailing in the crankcase.

12. The internal combustion engine according to claim 1, wherein the vacuum opening valve is configured to open at a predetermined vacuum in the crankcase and to close at pressures higher than that in the crankcase.

13. The internal combustion engine according to claim 1, wherein the vacuum opening valve is configured to open with a first opening cross section at a predetermined first vacuum in the crankcase, and to open with a second opening cross section, which is larger than the first opening cross section, at a predetermined second vacuum in the crankcase, which is larger in amount than the first vacuum, and to close at pressures above the first vacuum in the crankcase.

14. The internal combustion engine according to claim 1, wherein the vacuum opening valve is configured to be continuously open with a first opening cross section at pressures in the crankcase that are above a predetermined vacuum, and to open with a second opening cross section, which is larger than the first opening cross section, at a predetermined vacuum in the crankcase.

15. The internal combustion engine according to claim 1 further comprising a pressurized opening valve connected to the crankcase, wherein the pressurized opening valve opens as a function of an excess pressure prevailing in the crankcase to allow an outflow of blow-by gas out of the crankcase.

16. The internal combustion engine according to claim 15, wherein the pressurized opening valve is integrated into the vacuum opening valve.

17. The internal combustion engine according to claim 15 further comprising an activated carbon filter arranged in a flow path carrying the blow-by gas out of the crankcase through the pressurized opening valve.

18. The internal combustion engine according to claim 17, wherein the activated carbon filter is at least one of integrated into an air filter and forms an air filter that is arranged in the flow path carrying the fresh air through the pressurized opening valve into the crankcase.

19. The internal combustion engine according to claim 1, wherein the vacuum opening valve is at least one of arrangable on an oil filling cover of the internal combustion engine and integrated into the oil filling cover.

20. The internal combustion engine according to claim 1 further comprising an oil filling cover, wherein the vacuum opening valve is at least one of arranged on the oil filling cover and integrated into the oil filling cover.

* * * * *